United States Patent [19]

Rockel et al.

[11] Patent Number: 4,876,065

[45] Date of Patent: Oct. 24, 1989

[54] CORROSION-RESISTING FE-NI-CR ALLOY

[75] Inventors: Manfred Rockel, Friedrichsdorf; Ernst Wallis, Eschborn; Michael Köhler, Iserlohn; Ulrich Heubner, Werdohl; Rolf Kirchheiner, Iserlohn, all of Fed. Rep. of Germany

[73] Assignee: VDM Nickel-Technologie Aktiengesellschaft, Frankfurt am Main, Fed. Rep. of Germany

[21] Appl. No.: 196,034

[22] Filed: May 19, 1988

[30] Foreign Application Priority Data

May 19, 1987 [DE] Fed. Rep. of Germany ..... 3716665

[51] Int. Cl.[4] ..... C22C 30/00

[52] U.S. Cl. ..... 420/582; 420/586.1

[58] Field of Search ..... 420/582, 586.1, ; 148/442

[56] References Cited

U.S. PATENT DOCUMENTS 3,044,871 7/1962 Mott ..... 420/582
4,078,920 3/1978 Liljas et al. ..... 420/582
4,201,575 5/1980 Henthorne et al. ..... 148/442
4,487,744 12/1984 DeBold et al. ..... 420/582

FOREIGN PATENT DOCUMENTS 1950932 2/1971 Fed. Rep. of Germany .
1295889 11/1972 United Kingdom .

*Primary Examiner*—L. Dewayne Rutledge
*Assistant Examiner*—David W. Schumaker
*Attorney, Agent, or Firm*—Felfe & Lynch

[57] ABSTRACT

Disclosed in an improvement in a known Ni-Cr-Fe alloy.

The alloy of the invention contains 30 to 32% nickel; 26 to 28% chromium; 0.5 to 1.5% copper; 6 to 7% molybdenum; up to 2% manganese; up to 1.0% silicon; up to 0.2% aluminum; up to 0.03% carbon; 0.10 to 0.25% nitrogen; balance iron and usual impurities.

The alloy of the invention has increased pitting corrosion potential and critical crevice corrosion and pitting corrosion temperatures whereas the resistance of the alloy to commercially pure phosphoric acid has not been decreased.

16 Claims, 2 Drawing Sheets

3
1
4
2
1400
1300
1200
1100
1000
900
800
700
600
500
400
300
200
100
PITTING POTENTIAL mVH
(R)
20
40
60
80
100
ϑ [°C]
T (°C)

CORROSION-RESISTING FE-NI-CR ALLOY

BACKGROUND OF THE INVENTION

The present invention is in a modification of the alloy in accordance with Material No. 1.4563 (UNS N 00020) having the DIN Designation X 1 NiCrMoCu 3127 and its use.

That known alloy has the following composition:

| | |
|---|---|
| Ni | 30 to 32% |
| Cr | 26 to 28% |
| Mo | 3 to 4% |
| Cu | 0.8 to 1.5% |
| Mn | up to 2.0% |
| Si | up to 1.0% |
| Al | up to 0.2% |
| C | up to 0.02% |
| Fe | balance, inclusive of usual admixtures |

Fe balance, inclusive of usual admixtures

The above-described known alloy was developed in an effort to provide a material which especially resists corrosion by commercially pure phosphoric acids.

It is an object of the invention to further improve that known alloy's resistance to corrosion without adversely affecting its other properties.

THE INVENTION

That object has surprisingly been achieved by increasing the molybdenum content to between 6 and 7% and by an inclusion of 0.10 to 0.25% nitrogen. The higher molybdenum content distinctly improves the alloy's resistance to pitting and crevice corrosion in chloride-containing media. The nitrogen content, which is added by a blowing in gaseous form, stabilizes the austenitic structure and opposes the segregation of topological close-packed (TCP) phases from that structure. The known alloy generally has a nitrogen content well below 0.1%, and normally below about 0.06%.

When the nitrogen content is within the range of from 0.14 to 0.22%, preferably from 0.16 to 0.20% and particularly at about 0.18%, particularly desirable results are obtained.

The alloy of the invention is particularly effective when used as a material for making structural parts which are specified to meet one or more of the following requirements:

(a) rate of material removal less than 0.20 mm per year at 100° C. in commercial pure phosphoric acid having a chloride ion concentration up to 1000 ppm;

(b) a pitting corrosion potential of at least 1000 $mV_H$ (millivolts) at 75° C. and at least 800 $mV_H$ at 90° C.;

(c) in acid media having a chloride ion concentration of and above 50,000 ppm, a critical pitting corrosion temperature of at least 80° C. and a critical crevice corrosion temperature of at least 50° C.;

(d) the structural part should resist intergranular corrosion under the conditions specified in ASTM G 28, Practice A;

(e) a rate of material removal less than 0.5 mm per year under the conditions specified in ASTM G 28, Practice B; and (f) resistance to stress crack corrosion and pitting corrosion under the conditions of an accelerated acid gas test.

The alloy is produced in an electric arc or induction melting furnace, followed by an AOD or VOD treatment, as described in "Handbook of Stainless Steels", McGraw-Hill Book Comp., 1977. Any structural part producible from the known alloy can also be produced from the alloy of the invention using the same techniques as used with the known alloy.

Further details and advantages of the invention will be explained more fully with reference to the following tables and graphs.

Table 1 sets forth the chemical compositions of 5 times two specimens which were subjected to the subsequently described tests. Specimens 11 and 12 are illustrative embodiments of the alloy in accordance with the invention. Specimens 21 and 22 consist of the unmodified alloy, which contain less molybdenum and no nitrogen. Two specimens of each of three additional test alloys are also listed in the Table. Only the first digit of the specimen number will be used hereinafter to identify the five different alloys.

Figure 1:
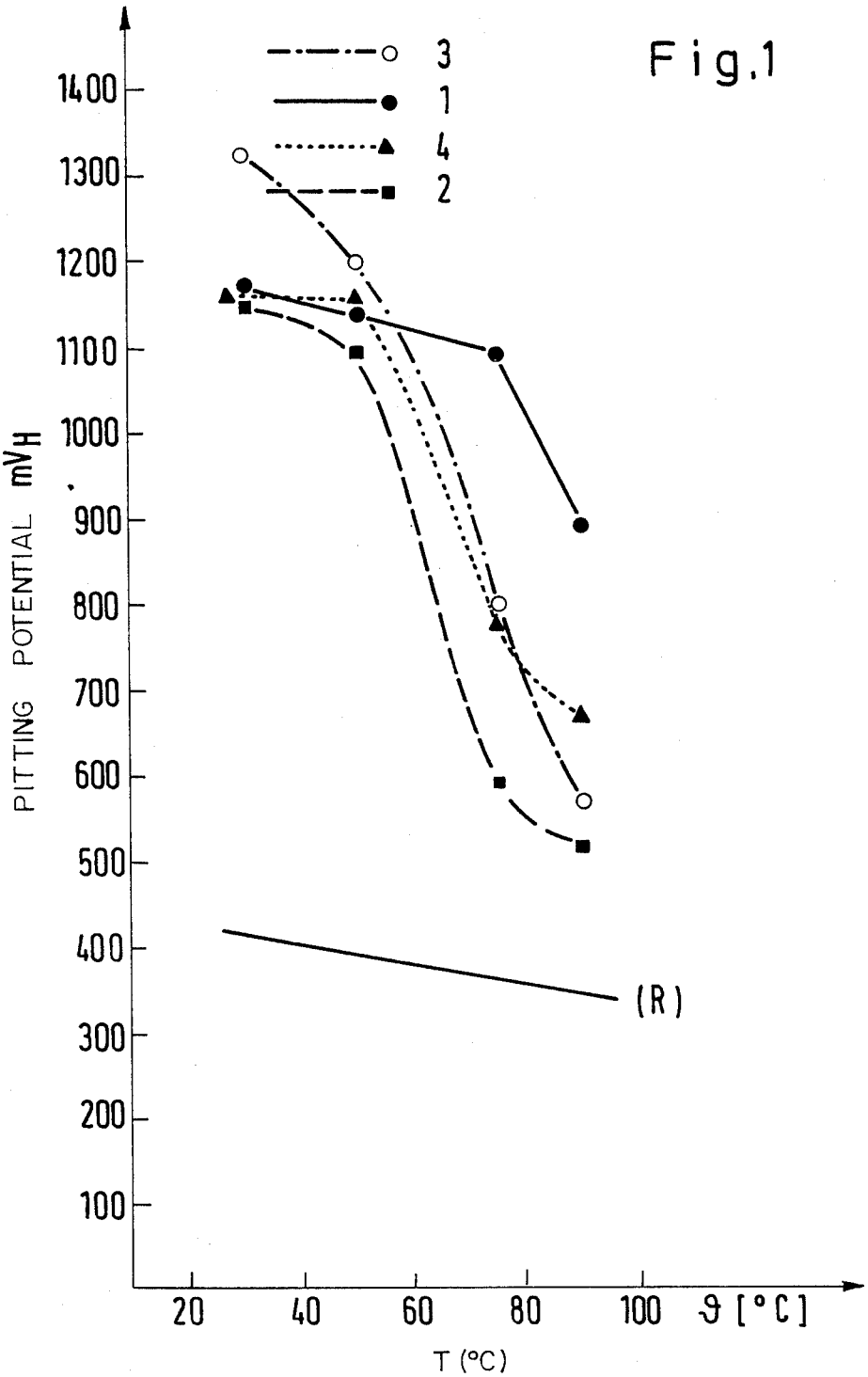
FIG. 1 is a plot of pitting potential in $mV_H$ and test temperature.

In FIG. 1, the pitting corrosion potentials, measured against the normal hydrogen electrode, of four tested alloys are plotted against the test temperature. It is readily apparent that the alloy of the invention is distinctly superior to all other alloys in the temperature range above 60° C. The values were determined according to ASTM G 5-78 and ASTM G 61-78 in aerated artificial sea water by potentiostatic measurements. The oxidation-reduction potential (R) of the testing medium is also stated at the bottom.

Table 2 contains particulars relating to different properties of the five alloys which were compared in the tests. The alloys are designated 1 to 5 in column 1. Column 2 relates to the critical crevice corrosion temperature (CCCT) and column 3 to the critical pitting corrosion temperature (CPCT), in either case in a 6% $FeCl_3$ solution. The CCCT and CPCT values were determined according to MTI manual No. 3. Column 4 contains values for the corrosion rates in commercially pure phosphoric acid (72% $H_3PO_4$). Column 5 indicates the rates of material removal under the conditions specified in ASTM G 28, Practice B. Finally, column 6 indicates the sensitizing time regarding the resistance to intergranular corrosion (IC) as ranges because strong fluctuations must be expected.

For the alloy in accordance with the invention the critical temperatures for crevice corrosion and pitting corrosion are distinctly higher than for the unmodified alloy. The temperature had been obtained before only by the material No. 5, which is a much higher alloy. The corrosion rates in commercially pure phosphoric acid are in the same range as those of the control alloy No. 2, which has been designed for that purpose. This substantiates that the alloy of the invention exhibits improvement in certain properties whereas other properties have not been adversely affected. With the material in accordance with the invention the rate of material removal stated in column 5 is lower by more than one tenth power than with the control materials. That face is particularly remarkable because it had previously been believed that molybdenum would improve the alloy corrosion resistance only in reducing acids. It is believed that the distinct improvement which has now been observed also in oxidizing acids is due to the combined actions of molybdenum and chromium.

Somewhat less desirable values must be tolerated only for the sensitizing time. But that property, which is particularly important for weldability, is not adversely affected to a significant degree in practice because even material No. 3 is regarded as readily weldable although its sensitizing time is only one-half or one-third that of the alloy of the invention.

acid gas tests have been developed, in which the specimens are tested, e.g., in a solution of 25% NaCl in an autoclave at 232° C. and under 50 bars $CO_2$, 10 bars $H_2S$ and 10 bars $H_2O$ for 35 days. The specimens consist of a triangular bending test specimen for which $\sigma B = 0.95 \times R_{P0.2}$. The bending best was conducted according to NACE TM 01-77. In such test, the alloy of the invention suffered no damage by stress crack corrosion and pitting corrosion.

TABLE 1

Chemical Composition of the Tested Specimens

| Specimen No. | Ni | Cr | Mo | Cu | Mn | Si | Al | C | Fe | $N_2$ | Ti | N[b] |
|---|---|---|---|---|---|---|---|---|---|---|---|---|
| 11 | 31.20 | 26.80 | 6.50 | 1.23 | 0.89 | 0.080 | 0.10 | 0.010 | balance | 0.16 | — | — |
| 12 | 31.50 | 27.10 | 6.60 | 1.18 | 0.96 | 0.130 | 0.09 | 0.030 | balance | 0.22 | — | — |
| 21 | 31.45 | 26.85 | 3.43 | 2.05 | 1.48 | 0.28 | — | 0.011 | balance | — | — | — |
| 22 | 30.65 | 26.75 | 3.46 | 1.21 | 1.50 | 0.30 | — | 0.008 | balance | — | — | — |
| 31 | 25.00 | 20.80 | 6.27 | 0.86 | 0.85 | 0.29 | — | 0.011 | balance | 0.020 | — | — |
| 32 | 24.75 | 20.70 | 6.10 | 0.85 | 0.87 | 0.28 | — | 0.009 | balance | 0.019 | — | — |
| 41 | 47.00 | 23.00 | 6.90 | 2.05 | 0.52 | 0.10 | — | 0.008 | balance | — | — | 0.49 |
| 42 | 47.30 | 22.7 | 6.70 | 2.10 | 0.49 | 0.12 | — | 0.010 | balance | — | — | 0.42 |
| 51 | balance | 21.85 | 9.16 | — | 0.05 | 0.22 | 0.10 | 0.026 | 3.13 | — | 0.17 | 3.55 |
| 52 | balance | 22.31 | 9.07 | 0.03 | 0.04 | 0.12 | 0.15 | 0.022 | 3.47 | — | 0.17 | 3.60 |

TABLE 2

Properties of the Alloys

| 1 Alloy | 2 CCCT (°C.) in 6% $FeCl_3$ | 3 CPCT (°C.) solution | 4 Corrosion rate (mm/y) in 72% $H_3PO_4$ | 5 Corrosion rate (mm/y) in accordance with ASTM G 28, Practice B | 6 Sensitizing time t (h) |
|---|---|---|---|---|---|
| 1 | 50–70 | 85 | 0.13–0.15 | 0.2 | 1–3 |
| 2 | 20–30 | 52.5 | 0.15 | 80 | 30–100 |
| 3 | 45 | 61.5 | — | 80 | 0.5–1 |
| 4 | 35 | 77.5 | 0.17 | — | 1–3 |
| 5 | 60 | 85 | 0.25 | — | 30–100 |

It can thus be concluded that the alloy of the invention, in comparison with the unmodified alloy, has improved properties as regards the pitting corrosion potential and the critical crevice corrosion and pitting corrosion temperatures without sacrifice of its resistance to commercially pure phosphoric acid. A modest decrease of the sensitizing time regarding the resistance to intergranular corrosion must be expected. But that decrease will not adversely affect the weldability.

Figure 2:
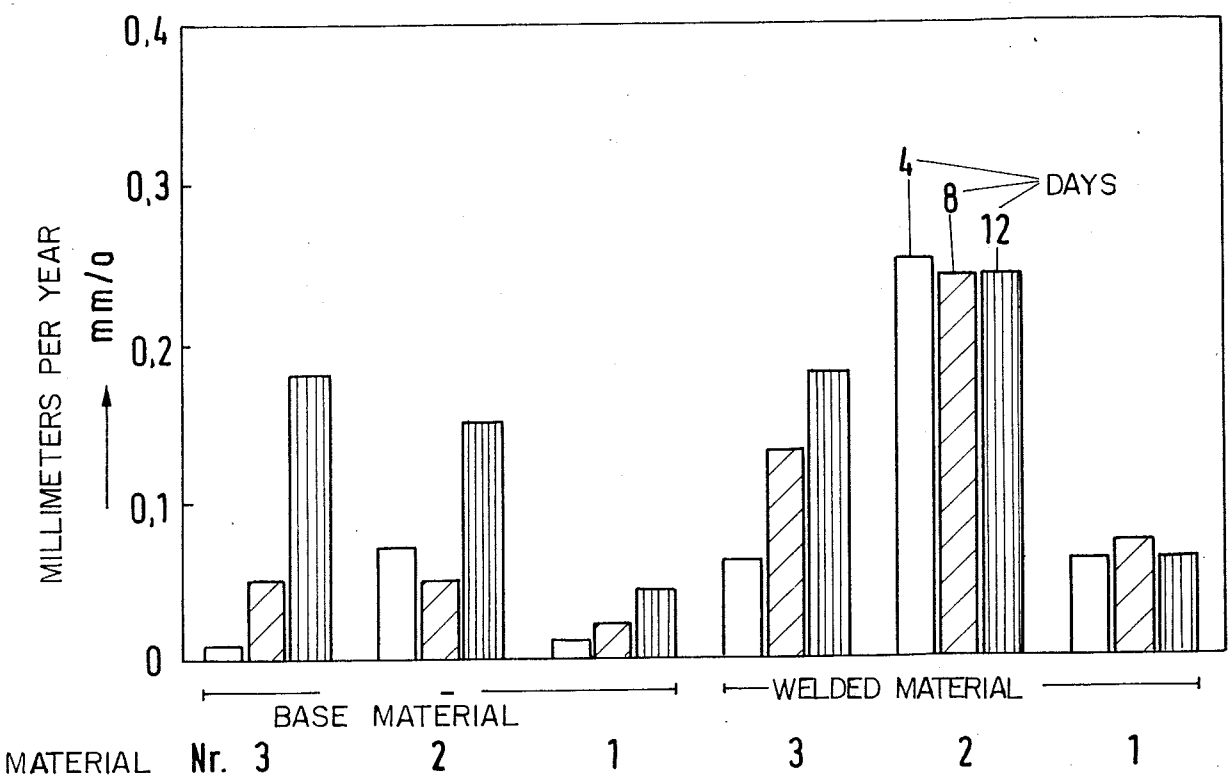
FIG. 2 shows in the columns in the left half of the diagram, corrosion data of unwelded specimens and corrosion data of welded specimens in the columns in the right half of the diagram.

In FIG. 2, the rates of material removal from three different materials in monochloroacetic acid are compared for the base material and for the welded material. The welding was by the TIG process, using an alloy 625 filler metal, the AWS designation of which is ERNiCr-Mo-3. In all cases the improved material 1 of the invention is superior to the control materials 2 and 3.

The test specified in ASTM G 28, Practice A, is used to test materials for their resistance to intergranular corrosion. It is carried out in a boiling solution that contains 50% $H_2SO_4$ and 3.7% $Fe_2(SO_4)_3$. Such conditions are encountered in practice, e.g., in the handling of contaminated sulfuric acids.

The test specified in ASTM G 28, Practice B, is used to determine the resistance of materials to corrosion in highly oxidizing acids which contain metal ions. A boiling solution containing 23% $H_2SO_4$, 1.2% HCl, 1% $FeCl_3$ and 1% $CuCl_2$ is used so that conditions are simulated such as are encountered, e.g., in pickling plants.

For a check of the resistance to stress crack corrosion under conditions which are encountered in deep boreholes drilled in search of natural gas and petroleum, It will be understood that the specification and examples are illustrative but not limitative of the present invention and that other embodiments within the spirit and scope of the invention will suggest themselves to those skilled in the art.

We claim:

1. An alloy consisting essentially of: 30 to 32% nickel; 26 to 28% chromium; 0.5 to 1.5% copper; 6 to 7% molybdenum; up to 2% manganese; up to 1.0% silicon, up to 0.2% aluminum, up to 0.03% carbon; 0.10 to 0.25% nitrogen; balance iron .

2. The alloy of claim 1 containing 0.14 to 0.22% nitrogen.

3. The alloy of claim 1 containing 0.16 to 0.20% nitrogen.

4. The alloy of claim 1 containing about 0.18% nitrogen.

5. A component comprising the alloy of claim 1.

6. The component of claim 5 having a rate of material removal below 0.5 mm per year in a solution heat-treated state.

7. A structural part formed of an alloy consisting essentially of 30 to 32% nickel; 26 to 28% chromium; 0.5 to 1.5% copper; 6 to 7% molybdenum; up to 2% manganese; up to 1.0% silicon, up to 0.2% aluminum, up to 0.03% carbon; 0.10 to 0.25% nitrogen; balance iron and usual impurities, the part having a high resistance to corrosion and having a rate of material removal below 0.20 mm per year at 100° C. in commercially pure phosphoric acid with a chloride ion concentration up to 1000 ppm.

8. The structural part of claim 7 having a high resistance to pitting corrosion in neutral or acid aqueous media which has a high chloride ion concentration.

9. The structural part of claim 7 having a high resistance to crevice corrosion in neutral or acid aqueous media which has a high chloride ion concentration.

10. The structural part of claim 7 having a pitting corrosion potential of at least 1000 $mV_H$ at 75° C. and of at least 800 $mV_H$ at 90° C. in neutral aqueous media having a chloride ion concentration of an order of 20,000 ppm.

11. The structural part of claim 7 having a critical pitting corrosion temperature of at least 80° C. and a critical crevice corrosion temperature of at least 50° C. in acid media with a chloride ion concentration of at least 50,000 ppm .

12. The structural part of claim 7 having a resistance to intergranular corrosion.

13. The structural part of claim 7 having the properties of resisting stress crack corrosion and pitting corrosion under the conditions of an accelerated acid gas test.

14. The structural part of claim 7 of an alloy containing 0.14 to 0.22% nitrogen.

15. The structural part of claim 7 of an alloy containing 0.16 to 0.20% nitrogen.

16. The structural part of claim 7 containing about 0.18% nitrogen.

* * * * *